US005192081A

United States Patent [19]

Cooper

[11] Patent Number: 5,192,081

[45] Date of Patent: Mar. 9, 1993

[54] MULTI-BLADE ARROWHEAD

[76] Inventor: Gary L. Cooper, HC-04 Box 62, Pocahontas, Ark. 72455

[21] Appl. No.: 462,455

[22] Filed: Jan. 9, 1990

[51] Int. Cl.[5] ..... F42B 6/08

[52] U.S. Cl. ..... 273/422; 30/304

[58] Field of Search ..... 273/420–422; 30/304.55, 353, 357, 346.55, 279 R, 299

[56] References Cited

U.S. PATENT DOCUMENTS 1,441,490 1/1923 Duncan ..... 30/304 X
2,888,264 5/1959 Sharrar et al. ..... 273/421 X
3,653,664 4/1972 Gentellalli ..... 273/421
4,254,958 3/1981 Bateman, III ..... 273/421

*Primary Examiner*—Paul E. Shapiro
*Attorney, Agent, or Firm*—Polster, Lieder, Woodruff & Lucchesi

[57] ABSTRACT

A hunting arrowhead carried by an arrow shaft includes at least one blade cluster made up of at least two blades in side-by-side relation, substantially parallel to one another and with cutting edges spaced from one another to make closely spaced, parallel cuts as they penetrate.

9 Claims, 1 Drawing Sheet

MULTI-BLADE ARROWHEAD

BACKGROUND OF THE INVENTION

This invention relates to hunting arrowheads, sometimes called broadheads. Ideally, arrows will fly accurately to a vital area of the quarry hunted and the bladed head will penetrate and slice through a large area to cause maximum hemorrhaging. The maximum hemorrhaging is important; it will cause death quickly and leave a trail which will lead to the quarry.

Prior art arrowheads have a plurality of "single," sharp-edged blades spaced symmetrically around a ferrule of the arrowhead. Such a conventional arrowhead tends not to create a large enough wound channel to kill the quarry quickly; because each single sharp blade slices a narrow cut in the direction of penetration, the wound tends to close at once. Hunters have had to choose between arrowheads that are small enough to fly accurately but that do not kill quickly, or large arrowheads that create longer wound channels which kill more quickly, but do not fly accurately.

Attempts have been made to overcome the problem by designing an expandable arrowhead. These, however, are unreliable in operation, are fragile, and do not penetrate well.

It is accordingly one object of this invention to provide an arrowhead with enhanced killing power on a hunting arrow which will fly accurately.

Another object is to provide such a broadhead which will penetrate well and provide wide wound channels for maximum hemorrhaging.

Other objects will become apparent to those skilled in the art in the light of the following description and accompanying drawing.

SUMMARY OF THE INVENTION

In accordance with this invention, generally stated, there is provided an improved arrowhead preferably of the type that is removably carried by an arrow shaft. The arrowhead includes at least one blade cluster that includes at least two blades with razor sharp edges, the blades being arranged in side-by-side relation, the blades being substantially parallel and the sharp edges of the blades, being spaced from one another. Preferably, the arrowhead includes a core with longitudinal slots arranged symmetrically around the core, and blade clusters are mounted in the slots, each cluster including at least two blades.

DESCRIPTION OF THE PREFERRED EMBODIMENT

Figure 1:
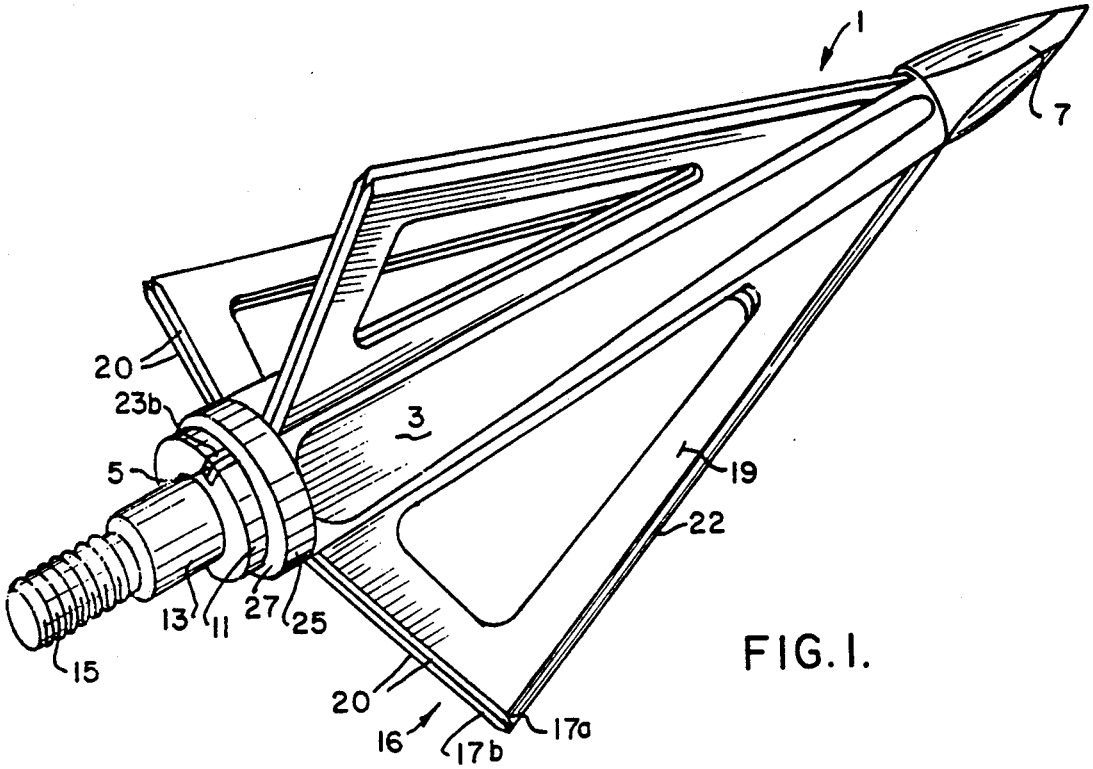
FIG. 1 is a perspective view of one embodiment of arrowhead of the present invention.
Figure 2:
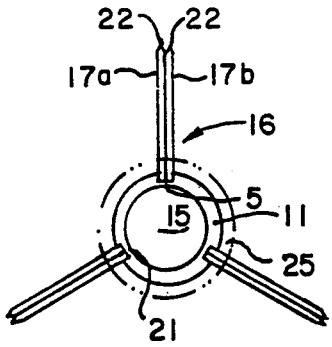
FIG. 2 is a rear elevational view of the arrowhead of FIG. 1.
Figure 3:
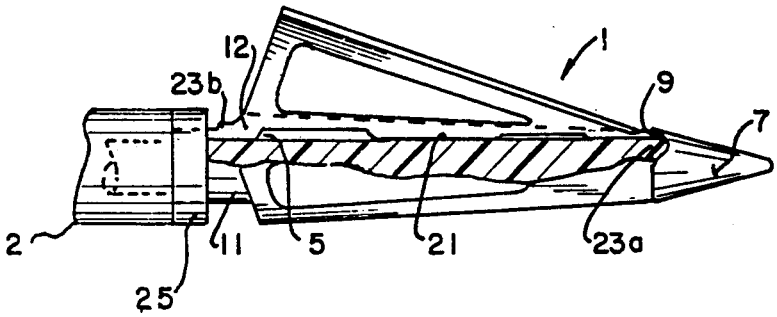
FIG. 3 is a side view, partially cut away, of the arrowhead of FIG. 1 on an arrow shaft.

Referring now to the Figures, reference numeral 1 indicates one illustrative embodiment of arrowhead of the present invention, which is carried on an arrow shaft 2. Arrowhead 1 comprises a core or ferrule 3 having a plurality of axially extending slots 5, evenly spaced around the ferrule 3. In this embodiment, ferrule 3 is capped by an arrow point 7 having recesses 9 at its rear end which are in alignment with slots 5. A rear fitting 11 at the rear end of ferrule 3 includes a shoulder 12 and a mounting shaft 13 having threads 15 at its rearward end. Slots 5 extend into rear fitting 11. Arrow shaft 2 has an internally threaded hollow end to receive and secure shaft 13. The fitting and arrow arrangement is conventional.

A blade cluster 16, having a pair of triangular blades **17*a* and 17*b*, is removably carried in each slot 5. Each blade has a web 19 that is cut out to lighten the blade and reduce drag when the arrow rotates. The web 19 has a base edge 21, an outwardly projecting edge 20 and a long cutting edge 22 extending from the outer end of the projecting edge 20 toward the forward end of the base edge 21. Front and rear mounting fingers 23*a*, and 23*b* project from the web along the base edge 20 at the forward and rearward ends thereof. Blades 17*a*, 17*b*** are the size of conventional small blades which fly accurately. In this embodiment, the blades have a base approximately 1½" long and a height of about ½" at their tallest point.

Front mounting finger **23*a* extends into and is caged within arrow tip recess 9 when base edge 21 is inserted in slot 5. Rear mounting arm 23*b* extends to and along rear fitting 11. A collar 25 fits over rear fitting 11 to cover and cage rear mounting arm 23*b* and abutts shoulder 12. When arrowhead 1 is screwed into arrow shaft 2, the top of shaft 2 is urged against an annular, radially flat back 27 of collar 25 to secure collar 25 around fitting 11 and to secure each blade cluster 16 in its lot 5**.

The use of a plurality of blades in side by side relation in a blade cluster with the edges of the blades spaced from one another, in effect cuts out a ribbon of tissue and creates a wound channel that is effectively much wider than the wound channel created by conventional arrowheads having only single blades. The wider wound channel creates greater hemorrhaging. Because it is wide, the wound channel will not seal so readily, resulting in a quicker kill and an obvious trail leading to the quarry.

The use of a plurality of blades in each blade cluster also strengthens the blade clusters, allowing for the use of thinner blades which would shatter if used singly. Because the blades can be small, the accuracy of the trajectory is not impaired. Thus, the arrowhead 1 provides an arrowhead which will fly accurately and which will create a wide wound channel.

In any case, when the blades of a cluster are immediately contiguous one another, the cutting edge should either be double beveled or, if single beveled, be mounted so that the bevels face one another, to leave a channel. If a thin shim or spacer plate is employed between the blades, the spacer itself will ensure that a double cut is produced.

Commercially available ferrules come equipped with slots that accommodate blades 0.040" or 0.020" thick, as well as those 0.010" thick. (See Hoyt-Easton Bow Bullet Broadhead, Rocky Mountain Razor and Satellite Aero broadheads, respectively, Bow Hunters Discount Warehouse catalog @1988/1989, pages 34, 35, for example). It can be seen that two 0.010" blades can be used in a 0.020" slot, or two 0.020" blades in a 0.040" slot, or two 0.010" blades with two outside 0.010" shims or with an intermediate 0.020" shim or spacer plate in a 0.040" slot. Blades of any thickness less than the width of the slot can be used, as long as the total thickness of the blades or blades and shims is the thickness that the slot is intended to accommodate. These are merely illustrative of ways in which conventional ferrules can be utilized. If three blades of conventional width are used, it may be necessary to mill a different width slot, or to use blades of different widths, as, for example one 0.020" and two 0.010" blades, or to use one or more shims or spacers. Of course, the ferrule can always be made specifically for the multi-blade clusters, with appropriately sized slots. The ferrule can be a hollow, elongated cone to which the blades are secured or with which the blades are integral and form the point, as in the Zwickey Delta Broadheads illustrated at page 33 of the referenced catalog. In any case, the blades will be considered mounted on the ferrule, within the meaning of the appended claims.

Numerous variations within the scope of the appended claims will be apparent to those skilled in the art in light of the foregoing description and accompanying drawings. Merely by way of example, the blades of multiple clusters could be permanently fixed to the arrowhead, rather then being replaceable, as is shown. Although the drawings show an arrowhead with three blade clusters, there may only be two or there may be four or more. Further, as has been indicated above, the blade cluster may alternatively have three or more blades, rather than just the two as described. The point may be eliminated, as in the Satellite 11-XL broadhead or Hoyt-Easton Bow Bullet broadhead illustrated at page 34 in the referenced catalog. The blade clusters may comprise one or more conventional single thick blades and at least one cluster having a plurality of cutting edges wherein the total thickness of the blades of the cluster is the same as that of the conventional blades, so as to maintain the symmetrical balance of the arrowhead. The blades of a cluster can be staggered axially of the arrow with respect to one another, still in side-by-side relation, and the blades can be of different widths or lengths, or thicknesses. The blades can be set at an angle to the axis of the arrow, as some conventional single blades are set, to encourage rotation of the arrow around its long axis in flight, or could even be curved, as long as the webs of the blades are substantially parallel and the cutting edges are spaced laterally from one another. A deviation in the angles between the cutting edges and the base of contiguous blades is tolerable, as long as the webs are parallel and the cutting edges are spaced, to produce a "channel" cut. Although the blades illustrated in the preferred embodiment shown have the web cut out to reduce drag, solid blades can be used. The blades of each cluster can be secured together before being inserted in the groove, as by adhering or brazing or the like. These variations are merely illustrative.

Having thus described the invention, what is claimed and desired to be secured by Letters Patent is:

1. In an arrowhead including an elongated ferrule, the improvement comprising at least one blade cluster mounted on said ferrule, said blade cluster comprising a plurality of blades mounted in side-by-side relation on said ferrule, said blades having webs parallel with one another and sharp edges spaced from one another to produce a channel cut as they penetrate, each of said blades including a blade web, a blade base, and front and rear mounting fingers at opposite ends of said base, said blades being mounted in axially extending groves in said ferrule and being mounted to said ferrule at their rear ends by a collar which covers said mounting fingers, said collar being held in securing position by said shaft.

2. The improvement of claim 1 including a plurality of said clusters, mounted on said ferrule and spaced symmetrically therearound.

3. The improvement of claim 1 wherein said blades are identical in size and shape, and are mounted coextensively and in contact with one another but for the said cutting edges.

4. The improvement of claim 1 wherein said blades are spaced from one another by a thin shim.

5. An arrowhead threadedly carried by an arrow shaft, said arrowhead comprising a ferrule, an arrow tip at one end of said ferrule and a threaded mounting shaft at another end to threadedly connect said arrowhead to said shaft, and a plurality of blade clusters evenly spaced around said ferrule, each blade cluster comprising a plurality of blades mounted in side-by-side relation on said ferrule, said blades having webs parallel with one another and sharp edges spaced from one another to create a wide wound channel in a hunted quarry, wherein said blade clusters are replaceably carried on said ferrule, the blades of each of said blade clusters including a base and a front and rear mounting finger, said base being mounted in an axial slot in said ferrule, the front mounting finger extending within and being caged by a recess in said arrow tip, said rear mounting finger cooperating with a collar at the rear of said ferrule to secure said blade cluster in place.

6. The arrowhead of claim 5, wherein the blades of each cluster are identical, are mounted immediately contiguous and in contact with one another and are coextensive over every part except the sharp edges, said sharp edges are defined by bevels along said cutting edges, bevels of contiguous blades facing one another.

7. In an arrowhead including an elongated ferrule having at least one axially extending groove in it, the improvement comprising at least one blade cluster mounted on said ferrule, said blade cluster comprising a plurality of blades mounted in side-by-side relation on said ferrule, said blades having webs parallel with one another and sharp edges spaced from one another to produce a channel cut as they penetrate, each of said blades including a blade web and a blade base, said blades of each cluster being mounted along their bases in one said axially extending groove in said ferrule.

8. The improvement of claim 7 wherein a plurality of blade clusters are arranged symmetrically about said ferrule, and wherein each said blade cluster comprises a plurality of small blades, which allows for accurate shooting of said arrow.

9. In an arrowhead including an elongate ferrule, the ferrule being connected to an arrow shaft, the improvement comprising a plurality of blade cluster spaced around said ferrule, said blade clusters extending axially on said ferrule, each blade cluster comprising a plurality of blades mounted on said ferrule, each of said blades having a web with a razor sharp edge defined by at least one bevel, said blades being mounted on said ferrule in side-by-side relationship, said edges of said blades being parallel and bevels of said blades facing one another to define a channel between them, the blades of each cluster being identical, being mounted immediately contiguous and in contact with one another and being coextensive over every part except the sharp edges, said sharp edges being defined by bevels along said cutting edges, bevels of contiguous blades facing one another.

* * * * *